United States Patent [19]

Opsal

[11] Patent Number: 4,479,595

[45] Date of Patent: Oct. 30, 1984

[54] BACK PACK

[75] Inventor: Roy T. Opsal, Calgary, Canada

[73] Assignee: Canadian Mountaineering Equipment Ltd., Calgary, Canada

[21] Appl. No.: 425,639

[22] Filed: Sep. 28, 1982

[51] Int. Cl.[3] ..... A45F 3/10

[52] U.S. Cl. ..... 224/211

[58] Field of Search ..... 224/151, 153, 155, 160, 224/161, 209, 210, 211, 212, 259, 261, 263, 908, 213; 150/49

[56] References Cited

U.S. PATENT DOCUMENTS

| | | | |
|---|---|---|---|
| 3,902,640 | 9/1975 | Geiben | 224/215 |
| 4,015,759 | 4/1977 | Dreissigacker et al. | 224/262 |
| 4,214,685 | 7/1980 | Pletz | 224/213 |

FOREIGN PATENT DOCUMENTS

| | | | |
|---|---|---|---|
| 26092 | 4/1981 | European Pat. Off. | 224/210 |

*Primary Examiner*—Steven M. Pollard
*Assistant Examiner*—David Voorhees
*Attorney, Agent, or Firm*—Ernest P. Johnson

[57] ABSTRACT

There is provided a back pack having an internal frame consisting of a T-shaped stay having its vertical member centrally positioned to overlie the user's spine. A load-transmitting, flexible, one-point connector extends between the pack bag, at the lower terminus of the frame, and the central rear segment of the hip belt. Stabilizer straps are provided to limit the movement of the pack bag. The one-point flexible connector permits of universal relative movement between the hip belt and the frame and associated pack bag, thereby providing a high level of capacity in the back pack to accommodate the movements of the user.

5 Claims, 3 Drawing Figures

1
9
6
3
2
7
17
23
8
5
14
8

BACK PACK

FIELD OF THE INVENTION

This invention relates to a back pack of the type having an internal frame and a hip belt.

BACKGROUND OF THE INVENTION

There have been a number of major developments, in the design of back packs, which are of interest with respect to the present invention. One such development has involved the incorporation of a frame with the pack bag and the connection of this frame to a hip belt, whereby part of the load may be transferred to the hips of the user. In addition, internal frames, comprising stays sewn into pockets of the bag, have, to some extent, supplanted the earlier rigid rectangular frames. Such internal frames, often consisting of spaced, vertical stays, permit one side of the frame to move relative to the other, as the user moves beneath the load. To achieve a further degree of flexibility, special connections between the frame and the belt have been developed, to permit of some freedom of relative movement between the belt and bag.

These features in the equipment have been developed to accommodate bending of the back and up and down and forward and backward movements of each hip and the hip-supported belt.

In addition, a sternum strap and adjustable stabilizer straps, connecting the pack bag with the hip belt and the shoulder harness, have been introduced to stabilize and limit the movement of the load, as required.

Stated otherwise, there has been a trend toward providing suspension systems for the pack bag which will better accommodate the movements of the hips and back of the user, while still maintaining the load in a desired, comfortable and stabilized position.

It is the object of the present invention to advance this trend by providing a novel suspension system which is characterized by a high order of capability for accommodating the various movements of the user.

SUMMARY OF THE INVENTION

In accordance with the broadest aspect of the present invention, there is provided a suspension system combining an internal frame with a load-transmitting, flexible, one-point connector extending between and connecting the pack bag and the central portion of the rear segment of the hip belt. Preferably, the frame has a lower terminus which is centrally located on the pack bag and the connector extends from this terminus to the hip belt. The connector is adapted to permit of universal movement of the frame and hip belt relative to each other. By universal movement is meant that:

(1) the belt and bag can each separately tilt sideways in a vertical plane;

(2) each can pivot to the front and rear relative to each other;

(3) each can rotate one side forward and the other to the rear; and (4) these movements can occur singly or in combination.

Having provided this universal connection, it is then desirable to be able to limit the extent of some of the movement of the pack bag. This is of course achieved to a large degree by the presence of the usual shoulder straps. However, it is also preferable to provide additional means for stabilizing the load. Such means may comprise one or more of the following: a sternum strap (a horizontal strap extending across the chest and connecting the sides of the pack bag); hip belt stabilizer straps (extending from each lower corner of the pack bag to the adjacent side segment of the hip belt); and shoulder harness stabilizer straps (extending from each side of the upper end of the pack bag to one of the shoulder straps).

A preferred connector for providing the flexible connection is a length of nylon webbing or comparable material and first and second securing means. The webbing is attached at one end by said first securing means to the hip belt and extends over to the closely adjacent lower terminus of the frame on the pack bag, where it is attached to said bag by the second securing means. Said first securing means may comprise stitching; said second securing means may comprise a slide buckle connected by a loop to the pack bag. The buckle is disengageable, in the sense that it can be loosened and moved longitudinally along the webbing, to lengthen or shorten the connector. As a result, the load-transmittal point can be adjusted to higher or lower levels, as desired.

The internal frame preferably comprises one or more stays extending upwardly along the pack bag from a central lower terminus. More preferably, the frame comprises a single vertical stay extending along the vertical midline of the bag, to substantially overlie the spine of the user. Most preferably, an integral crosspiece is provided at the top of the vertical stay, so that it has a T-shaped configuration.

In another preferred feature, a pad is provided, extending upwardly from the central rear segment of the hip belt, to separate the stay from the wearer's lower spinal area and provide protection thereto.

In still another preferred feature, horizontal, longitudinally extending stay means are provided in the hip belt to assist it in resisting torsional stress arising from the load.

Broadly stated, the invention is a back pack comprising: a hip belt; a pack bag; an internal frame associated with the pack bag, said frame comprising a vertically directed stay extending centrally up the pack bag so as to substantially correspond in use with the spine of the user; a flexible connector joining the central rear segment of the belt with the pack bag adjacent the lower terminus of the frame, said connector being operative to transmit load from the pack bag to the hip belt and to enable universal movement of said belt and frame relative to each other; adjustable means for stabilizing the pack bag; and a pair of shoulder straps, each interconnecting the central upper end portion of the pack bag with a lower corner portion thereof.

DESCRIPTION OF THE PREFERRED EMBODIMENT

Figure 1:
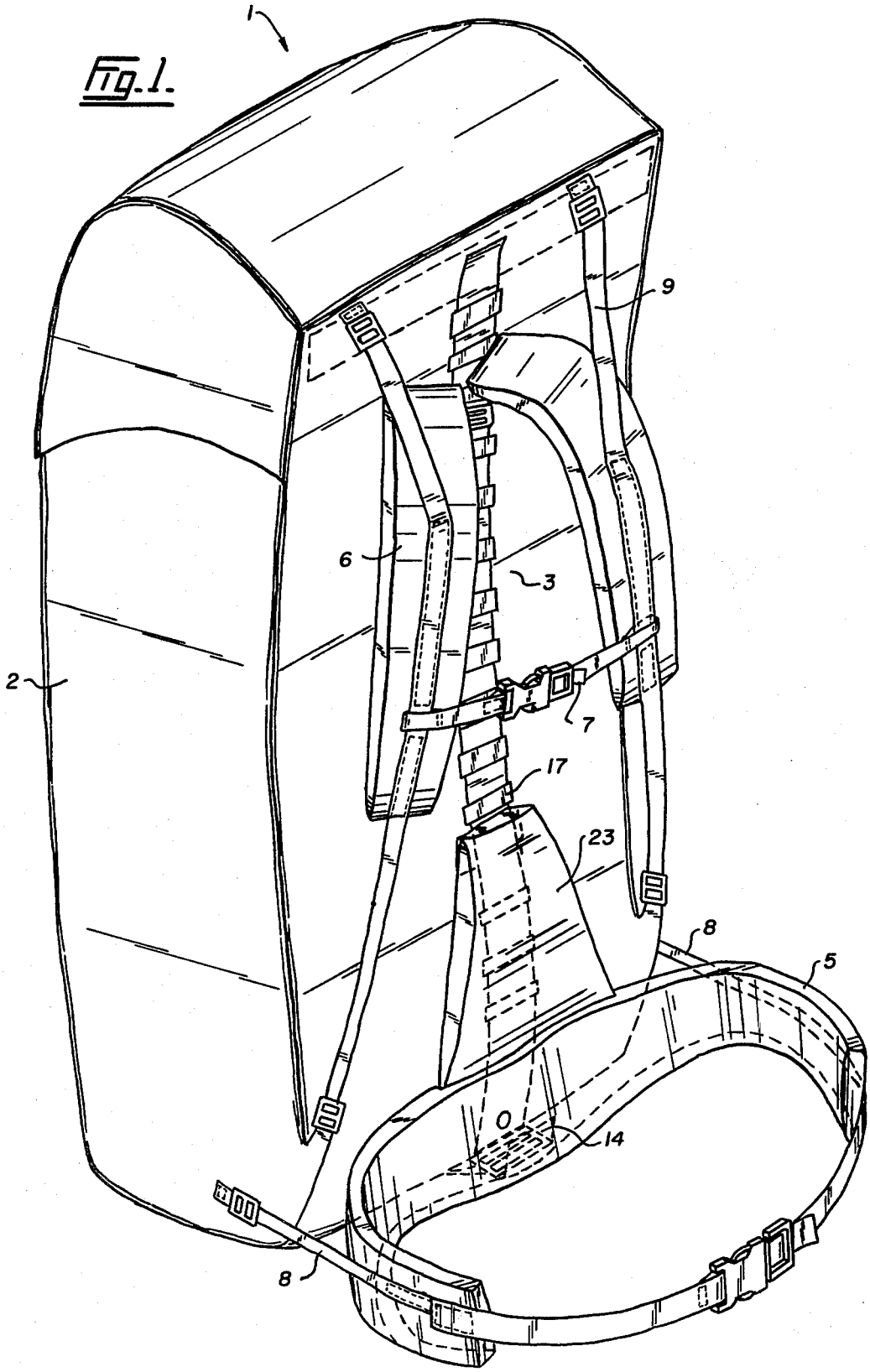
FIG. 1 is a perspective front view of the back pack, showing some hidden parts in broken lines.
Figure 2:
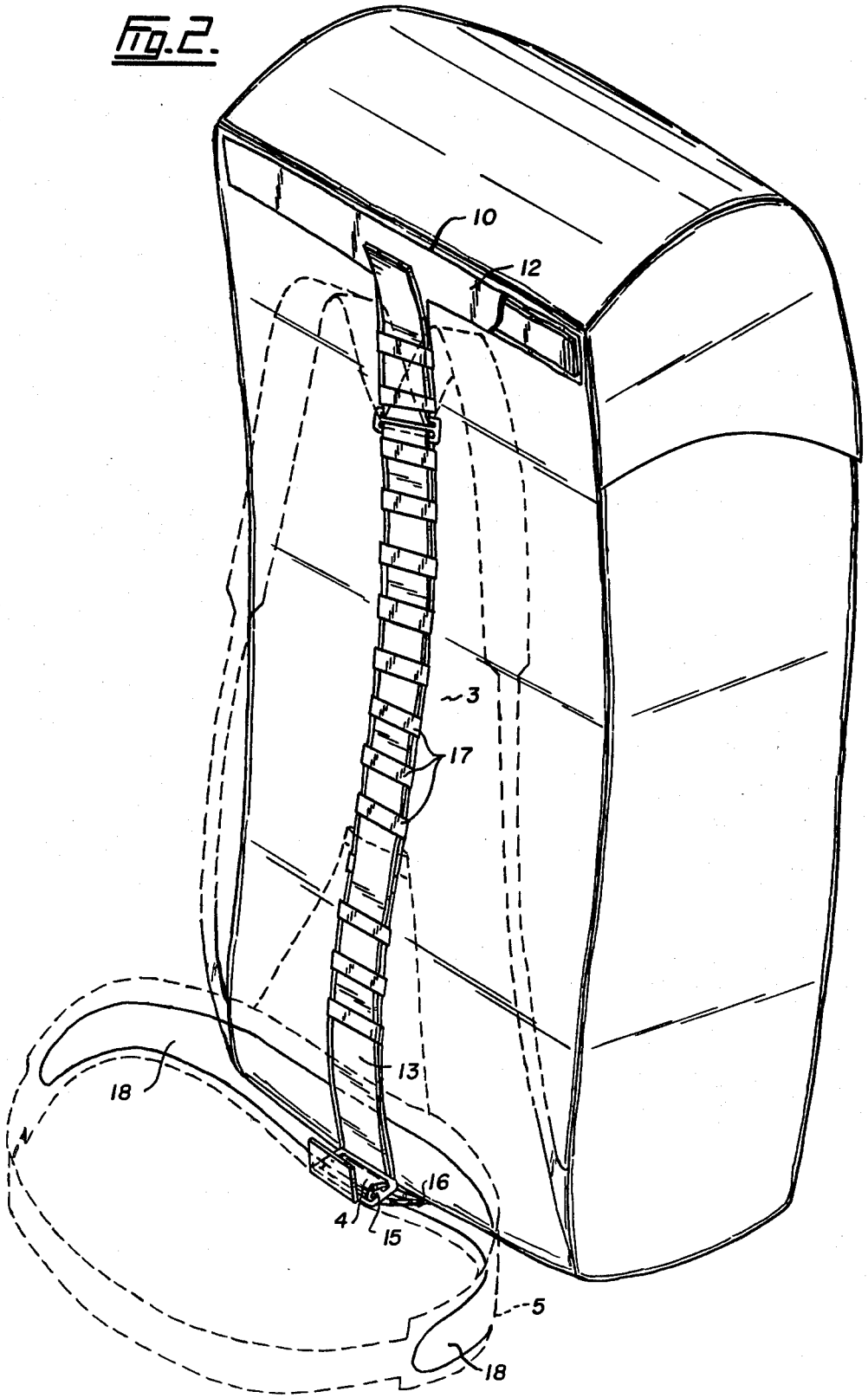
FIG. 2 is a perspective front view showing the connector and pack bag, the other parts being removed for illustrative purposes.
Figure 3:
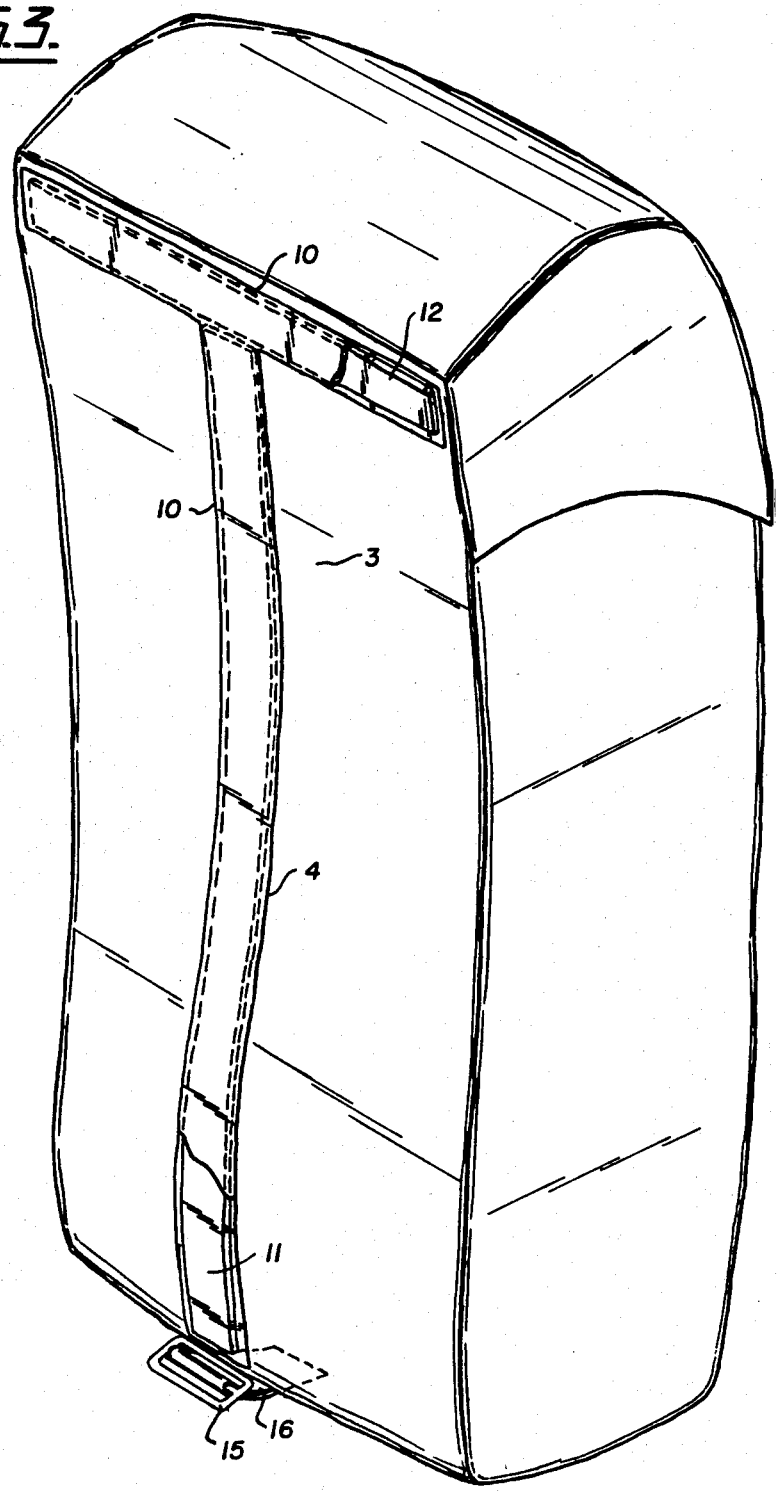
FIG. 3 is a front partly broken away perspective view of the bag, showing the stay in place with the hip belt and connector removed.

The back pack 1 comprises a pack bag 2 having an internal frame 3. A single load-transferring connector 4 connects the frame 3 with a hip belt 5. Shoulder harness straps 6 extend between the central upper portion of the bag 2 and the latter's lower corners. Adjustable stabilizing means, comprising a sternum strap 7, hip belt stabilizer straps 8, and shoulder harness stabilizer straps 9, are provided and function to stabilize the pack bag load.

More particularly, the inner surface of the pack bag 2 has a T-shaped pocket 10, in which is positioned an internal T-shaped frame 3 consisting of a vertical stay 11 and horizontal stay 12. The vertical stay 11 is centrally positioned, so as to substantially coincide with the spine of the user. The horizontal stay 12 is positioned to extend across the shoulders of the user.

The connector 4 is a single-point, load-transferring means connecting the hip belt 5 and frame 3. It comprises a length of flexible nylon webbing 13. Stitches 14 attach one end of the webbing 13 to the central rear segment of the hip belt 5. The free end of the webbing 13 extends through a slide buckle 15, which is attached to a loop 16 sewn to the bag 2 at the lower terminus of the stay 11. The buckle 15 and loop 16 lock or secure the webbing 13 to the bag 2. The connector 4 therefore comprises the webbing and the securing means attaching the webbing to the hip belt and bag respectively.

The length of the webbing segment, which extends between the hip belt 5 and bag 2, can be increased or decreased by adjusting the positioning of the slide buckle 15. As a result, the positioning of the centre of the bag load can be adjusted along the length of the user's back.

The front end of the webbing 13 is inserted through a series of crosspieces 17, to keep it tucked out of the way.

It is to be noted that the webbing 13 provides a flexible joint which is operative to transmit load from the frame 3 to the hip belt 5, while permitting universal movement of the belt and bag, relative to each other, to occur.

The padded hip belt 5 has a flat stay 18, shown in solid lines in conjunction with the broken line outline of the hip belt. This stay 18 extends on edge longitudinally along its length. The stay 18 functions to stiffen the belt against rotation and to distribute the load from the one point connection with the connector 4 along the length of the belt.

Longitudinally adjustable stabilizer strap means are provided to stabilize the bag load. More particularly, a sternum strap 7 connects the sides of the bag 2 across the chest of the user. A pair of hip belt stabilizer straps 8 connect each lower corner of the bag 2 with the adjacent side segment of the hip belt 5. And a pair of shoulder harness stabilizer straps 9 connect the upper portion of the bag 2 with the shoulder harness straps 6. While it is preferable to incorporate all of the above mentioned stabilizer straps for use when needed, it is within the scope of the invention to utilize none or only one or two of them.

A pad 23 extends upwardly from the central rear segment of the hip belt 5, to protect the spine of the user against the action of the stay 11.

This combination of components functions to provide a back pack having a high degree of capability to accommodate the movements of the user.

The scope of the invention is defined by the now following claims.

The embodiments of the invention in which an exclusive property or privilege is claimed are defined as follows:

1. A back pack comprising:

a hip belt;

a pack bag;

an internal frame associated with the pack bag, said frame comprising a vertically directed stay extending centrally up the pack bag so as to substantially correspond in use with the spine of the user;

a flexible connector joining the central rear segment of the belt with the pack bag adjacent the lower terminus of the frame, said connector being operative to transmit load from the pack bag to the hip belt and to enable universal movement of said belt and frame relative to each other;

adjustable means for stabilizing the pack bag; and a pair of shoulder straps, each interconnecting the central upper end portion of the pack bag with a lower corner portion thereof.

2. The back pack as set forth in claim 1 wherein:

the connector comprises a length of flexible material, briding between the hip belt and pack bag, and first and second securing means attaching the length to said belt and bag respectively, and wherein the second securing means is disengageable whereby the length of the bridging portion may be adjusted.

3. The back pack as set forth in claim 1 wherein:

the frame is T-shaped and consists of a vertically directed stay extending centrally up the pack bag, and a horizontally directed stay, extending across the upper portion of said bag.

4. The back pack as set forth in claim 1 wherein:

the hip belt comprises longitudinally extending means for stiffening the belt against rotation.

5. The back pack as set forth in claim 2 comprising:

pad means for protecting the lower spinal region of the wearer from the stay is associated with the hip belt.

* * * * *